US006217008B1

(12) United States Patent
Abe et al.

(10) Patent No.: US 6,217,008 B1
(45) Date of Patent: Apr. 17, 2001

(54) DIAPHRAGM-TYPE CARBURETOR

(75) Inventors: Hitoshi Abe; Hirohisa Ishikawa; Naoyuki Kamiya, all of Wako (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/361,174

(22) Filed: Jul. 27, 1999

(30) Foreign Application Priority Data

Jul. 28, 1998 (JP) ..... 10-212210

(51) Int. Cl.[7] ..... F02M 17/04

(52) U.S. Cl. ..... 261/34.1; 261/35; 261/69.2; 261/DIG. 68; 261/DIG. 83

(58) Field of Search ..... 261/34.1, 35, 37, 261/71, 64.1, 54, 69.1, 69.2, DIG. 23, DIG. 24, DIG. 38, DIG. 39, DIG. 68, DIG. 83, DIG. 84, DIG. 8

(56) References Cited

U.S. PATENT DOCUMENTS 3,765,657 * 10/1973 Du Bois ..... 261/71 X
3,825,237 * 7/1974 Aoyama et al. ..... 261/DIG. 68
4,003,968 * 1/1977 Rickert ..... 261/34.1 X
4,271,093 * 6/1981 Kobayashi ..... 261/DIG. 8
5,441,673 * 8/1995 Gerhardy ..... 261/DIG. 68
5,599,484 * 2/1997 Tobinai ..... 261/35
5,676,887 * 10/1997 Soeda et al. ..... 261/DIG. 68
5,681,508 * 10/1997 Gerhardy ..... 261/35

FOREIGN PATENT DOCUMENTS 1-151758 6/1989 (JP) .

* cited by examiner

*Primary Examiner*—Richard L. Chiesa
(74) *Attorney, Agent, or Firm*—Arent Fox Kintner Plotkin & Kahn

(57) ABSTRACT

In a diaphragm-type carburetor, a fuel vapor treating chamber is provided in a downstream fuel passage which interconnects a fuel pump operated in response to a pulsation pressure from a pulsation pressure generating source and an inlet bore in a constant-pressure fuel chamber. The fuel vapor treating chamber is located before the inlet bore, and a porous element for finely dividing fuel vapor is placed in the fuel vapor treating chamber. Thus, when a fuel vapor is generated in the fuel discharged from the fuel pump, a large amount of fuel vapor can be prevented from being ejected all at one time from a fuel nozzle by finely dividing the fuel vapor and introducing it along with the fuel into the constant-pressure fuel chamber, it is immediately passed toward the fuel nozzle, whereby the variation in air-fuel ratio of a fuel-air mixture can be suppressed to a very small level.

2 Claims, 2 Drawing Sheets

DIAPHRAGM-TYPE CARBURETOR

BACKGROUND OF THE INVENTION

1. Field of the Invention

The present invention relates to a diaphragm-type carburetor, and in particular, to an improvement in a diaphragm-type carburetor including a constant-pressure fuel chamber having an outlet bore communicating with a lower end of a fuel nozzle through a fuel jet and a check valve, a fuel pump incorporated in a fuel passage which communicates between an inlet bore in the constant-pressure fuel chamber and a fuel tank for providing fuel for the constant-pressure fuel chamber in response to a pulsation pressure in a pulsation pressure generating source, and a fuel introduction control valve for controlling the introduction of the fuel into the constant-pressure fuel chamber by opening or closing the inlet bore in the constant-pressure fuel chamber. The fuel introduction control valve is provided with a cylindrical valve seat member mounted on an upper wall of the constant-pressure fuel chamber and having the inlet bore in its upper end, and a valve member lifted and lowered within the valve seat member to open and close the inlet bore.

2. Description of the Related Art

A diaphragm-type carburetor is already known, as disclosed, for example, in Japanese Patent Application Laid-Open No. 1-151758.

In such a carburetor, fuel delivered to a constant-pressure fuel chamber by operation of a diaphragm pump is often converted into a large amount of fuel vapor by a pressure pulsation received from the diaphragm pump, heat or vibration received from an engine or the like. When a large amount of fuel vapor is introduced all at one time into the constant-pressure fuel chamber and ejected from the fuel nozzle, the fuel-air ratio of the fuel-air mixture is extremely reduced, thereby causing misoperation of the engine.

SUMMARY OF THE INVENTION

Accordingly, it is an object of the present invention to provide a diaphragm-type carburetor of the above-described type, wherein when fuel vapor is generated in the fuel discharged from the diaphragm pump, a large amount of fuel vapor can be prevented from being ejected all at one time from the fuel nozzle by finely dividing the fuel vapor and introducing it along with the fuel, thereby substantially suppressing the variation in fuel-air ratio of a fuel-air mixture.

To achieve the above object, according to a first aspect and feature of the present invention, there is provided a diaphragm-type carburetor comprising a constant-pressure fuel chamber having an outlet bore communicating with a lower end of a fuel nozzle through a fuel jet and a check valve, a fuel pump incorporated in a fuel passage for permitting communication between an inlet bore in the constant-pressure fuel chamber and a fuel tank. The pump pumps fuel into the constant-pressure fuel chamber in response to a pulsation pressure in a pulsation pressure generating source, and a fuel introduction control valve for controlling the introduction of the fuel into the constant-pressure fuel chamber by opening and closing the inlet bore in the constant-pressure fuel chamber. The fuel introduction control valve has a cylindrical valve seat member mounted on an upper wall of the constant-pressure fuel chamber and has the inlet bore at the upper end thereof. A valve member is raised and lowered within the valve seat member to open and close the inlet bore, wherein a fuel vapor treating chamber is provided in the fuel passages for finely dividing fuel vapor at a location before the inlet bore.

With the above arrangement, when fuel vapor is generated in the fuel discharged from the fuel pump, the fuel vapor is finely divided in the fuel vapor treating chamber and passes through the inlet bore in the valve seat member along with the fuel into the constant-pressure fuel chamber. Therefore, the finely divided fuel vapor passes smoothly into the fuel nozzle along with the fuel without stagnating in the constant-pressure fuel chamber. Thus, the amount of fuel vapor ejected from the fuel nozzle per unit time is relatively small, whereby the reduction in fuel-air ratio of a fuel-air mixture can be suppressed to a small level to ensure the normal operation of the engine.

According to a second aspect and feature of the present invention, a porous element having a large number of pores is placed in the fuel vapor treating chamber.

With the above arrangement, the fuel vapor can be finely divided by a simple structure, wherein the porous element is placed in the fuel vapor treating chamber, and thus, it is possible to provide a diaphragm-type carburetor at a lower cost.

The above and other objects, features and advantages of the invention will become apparent from the following description of the preferred embodiment taken in conjunction with the accompanying drawings.

DESCRIPTION OF THE PREFERRED EMBODIMENTS

Figure 1:
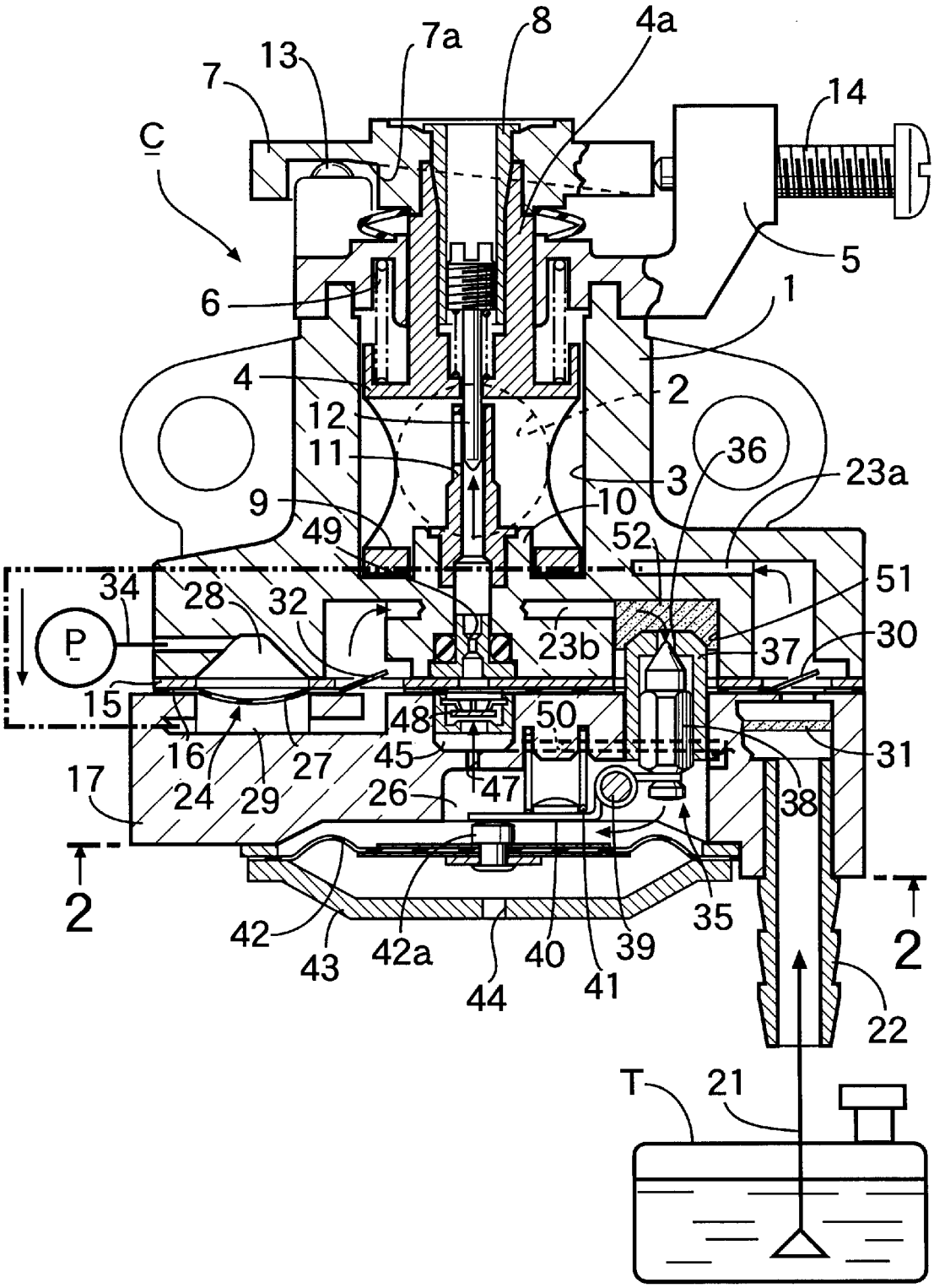
FIG. 1 is a vertical sectional front view of a diaphragm-type carburetor of the present invention.

Referring first to FIG. 1, a diaphragm-type carburetor C is mounted in a hand-held type engine carried on a portable working machine adapted to be used in all-direction attitudes, such as a mowing-off machine. A carburetor body 1 of the carburetor C includes a horizontal intake passage 2 connected to an intake port (not shown) of the engine, and a bottomed cylindrical valve guide bore 3 extending in a vertical direction perpendicular to the intake passage 2. A rotary-type throttle valve 4 is rotatably and slidably received in the valve guide bore 3, and a cap 5 for closing the valve guide bore 3, is secured to the carburetor body 1. A spring 6 is mounted under compression between the throttle valve 4 and the cap 5 for biasing the throttle valve 4 toward a bottom of the valve guide bore 3. The throttle valve 4 has a throttle bore 9 provided so that the area of communication with the intake passage 2 is increased in response to the rotation of the throttle valve 4 in an opening-degree increasing direction.

The throttle valve 4 has a valve stem 4*a* extending through the cap 5, and an operating arm 7 is secured to the valve stem 4*a* by a sleeve 8 fitted in a hollow in the valve stem 4*a*.

A boss 10 is provided in the bottom of the valve guide bore 3 to protrude into the throttle bore 9, and a fuel nozzle 11 is mounted to the boss 10 and rises in the throttle bore 9. A needle valve 12, threadedly mounted in the sleeve 8, is inserted into the fuel nozzle 11.

An annular slant 7*a* is formed on a lower surface of the operating arm 7 and the operating arm 7 is supported by a ball 13 mounted on an upper surface of the cap 5. When the operating arm 7 is rotated in a direction to open the throttle valve 4, it is pushed up by the ball 13, and with this pushing, the throttle valve 4 is displaced upwards along with the needle valve 12 against the biasing force of the spring 6, thereby increasing the opening degree of the fuel nozzle 11.

A stopper bolt 14 is threadedly mounted in the cap 5 for regulation of advancing and retracting movement, and is adapted to abut against the operating arm 7 to define an idle opening degree of the throttle valve 4.

A pressure plate 15, a resilient packing 16 and a bottom plate 17 are coupled to a lower surface of the carburetor body 1 in a sequentially superposed manner. A fuel pipe 21 connected to a fuel tank T is connected to a joint 22 which projects from a lower surface of one side of the bottom plate 17. An upstream fuel passage 23*a* in carburetor body 1 is connected to the joint 22, and a pump chamber 29 in a diaphragm-type fuel pump 24 in bottom plate 17. A downstream fuel passage 23*b* is provided in the carburetor body 1 and connected to the pump chamber 29, and a constant-pressure fuel chamber 26 is provided in the bottom plate 17 and is connected to the downstream fuel passage 23*b*.

The diaphragm-type fuel pump 24 has a diaphragm 27 which is formed by a portion of packing 16. An operating chamber 28 and the pump 29 chamber faced by upper and lower surfaces of the diaphragm 27, are formed on the carburetor body 1 and the bottom plate 17, respectively. An intake valve 30 utilizing a portion of the packing 16, and a fuel filter 31 located upstream of the intake valve 30, are mounted in the upstream fuel passage 23*a*, and a discharge valve 32 likewise utilizing a portion of the packing 16, is mounted in the downstream fuel passage 23*b*. The operating chamber 28 communicates with a pulsation pressure generating source P, e.g., the inside of a crank chamber or an intake pipe through a conduit 34.

Figure 2:
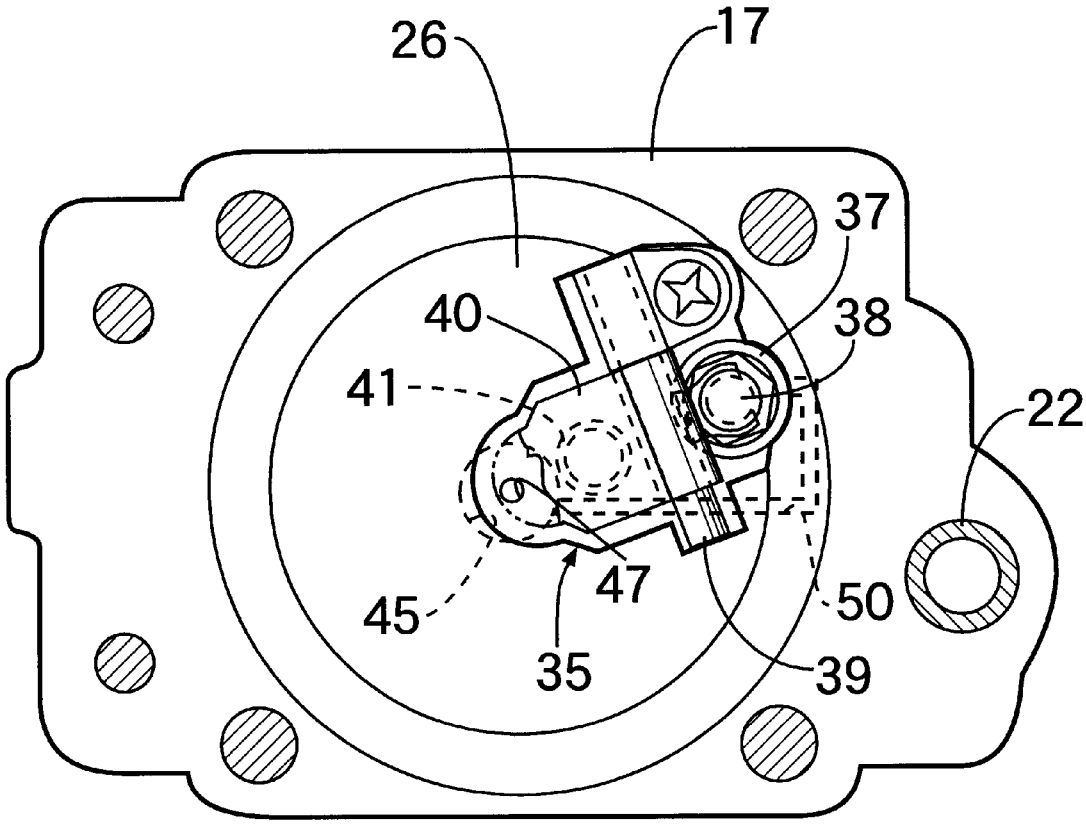
FIG. 2 is a sectional view taken along a line 2—2 in FIG. 1.

As shown in FIGS. 1 and 2, a fuel introduction control valve 35 is mounted in the constant-pressure fuel chamber 26 for controlling the introduction of fuel from the downstream fuel passage 23*b* into the constant-pressure fuel chamber 26. The fuel introduction control valve 35 is comprised of a cylindrical valve seat member 37 mounted on the bottom plate 17 on one side of the constant-pressure fuel chamber 26, so that an inlet bore 36 in an upper end wall faces the downstream fuel passage 23*b*. A valve member 38 is vertically movably received in the valve seat member 37 to open and close the inlet bore 36, and an operating lever 40 which is swingably carried on a support shaft 39, is supported on the bottom plate 17 with one end engaged with a lower end of the valve member 38. A valve spring 41 biases the operating lever 40 in a direction to close the valve member 38, and a diaphragm 42 is mounted on a lower surface of the bottom plate 17 so as to form a bottom surface of the constant-pressure fuel chamber 26. A urging element 42*a* is mounted at a central portion of the diaphragm 42 to abut against the other end of the operating lever 40 for movement away from such other end. The diaphragm 42 has a peripheral edge fastened to the bottom plate 17 along with a cover 43 which covers the diaphragm 42. The cover 43 is provided with an air vent 44 for applying atmospheric pressure to a lower surface of the diaphragm 42.

A fuel vapor treating chamber 51 is provided in the downstream fuel passage 23*b* at a location short of the inlet bore 36 of the valve seat member 37, and a porous element 52 having a large number of pores is placed in the fuel vapor treating chamber 51. The porous element 52 is formed of a material having a resistance to gasoline, such as a foamed resin having open cells or a sintered material.

A fuel well 45 is defined in the bottom plate 17 and is located above the other end of the constant-pressure fuel chamber 26. The fuel well 45 communicates at its lower portion with the constant-pressure fuel chamber 26 through an outlet bore 47 and at its upper portion with a lower end of the fuel nozzle 11 through a check valve 48 and a fuel jet 49.

Further, a bypass passage 50 is provided in the bottom plate 17 and passes above the constant-pressure fuel chamber 26 to permit the lower end of the valve seat member 37 to communicate with the fuel well 45.

The operation of the embodiment will be described below.

When the engine is operated, a pulsation pressure in the pulsation pressure generating source P is applied to the operating chamber 28 in the fuel pump 24 to vibrate the diaphragm 27. When the diaphragm 27 is flexed toward the operating chamber 28, the pump chamber 29 is increased in volume, thereby pumping fuel in the fuel tank T through the intake valve 30 and the upstream fuel passage 23*a*. When the diaphragm 27 is flexed toward the pump chamber 29, the pump chamber 29 is reduced in volume, thereby delivering the fuel therein toward the downstream fuel passage 23*b* through the discharge valve 32.

In this case, if the fuel in the constant-pressure fuel chamber 26 does not reach a defined amount, the diaphragm 42 is displaced upwards under the action of the atmospheric pressure to swing the operating lever 40 in a clockwise direction as viewed in FIG. 1 against the biasing force of the valve spring 41, thereby pulling down the valve member 38 to open the inlet bore 36. Therefore, the fuel in the downstream fuel passage 23*b* is introduced into the constant-pressure fuel chamber 26. When the fuel introduced into the constant-pressure fuel chamber 26 reaches the defined amount, the diaphragm 42 is lowered to pull the urging element 42*a* away from the operating lever 40. Then, the operating lever 40 pushes up the valve member 38 by the action of the biasing force of the valve spring 41, thereby closing the inlet bore 36. Thus, the introduction of the fuel into the constant-pressure fuel chamber 26 is stopped. In this manner, the defined amount of fuel is constantly stored in the constant-pressure fuel chamber 26 during operation of the engine and passes through the outlet bore 47 to fill the fuel well 45.

On the other hand, in the intake passage 2 and the throttle bore 9, a negative pressure is produced around the fuel nozzle 11. The fuel in the fuel well 45 rises sequentially in the check valve 48, the fuel jet 49 and the fuel nozzle 11 and ejected into the throttle bore 9 by the action of such negative pressure. The ejected fuel is drawn into the engine, while being mixed with air passed through the intake passage 2 and the throttle bore 9 to produce a fuel-air mixture. The amount of fuel-air mixture into the engine is regulated by increasing or decreasing the opening degree of the throttle valve 4.

When the fuel delivered from the fuel pump 24 into the downstream fuel passage 23*b* is subjected to a pressure pulsation caused by the vibration of the diaphragm, heat or vibration from the engine or the like, thereby generating fuel vapor, the fuel vapor is finely divided along with the fuel by the large number of pores in the porous element 52 in the fuel vapor treating chamber 51 and then introduced through the inlet bore 36 in the valve seat member 37, along with the fuel, into the constant-pressure fuel chamber 26. Therefore, the finely divided fuel vapor passes smoothly from the outlet 47 into the fuel well 45 along with the fuel without stagnating in the constant-pressure fuel chamber.

Particularly, in the illustrated embodiment, the lower end of the valve seat member 37 communicates with the fuel well 45 through the bypass passage 50 extending above the constant-pressure fuel chamber 26. Therefore, when the fuel vapor passes through the valve seat member 37, it immediately rises up in the bypass passage 50 to enter the fuel well 45. Thus, the fuel vapor is ejected from the fuel nozzle 11 along with the fuel in the fuel well 45. Therefore, the amount of fuel vapor ejected per unit time from the fuel nozzle 11 is very small and the fuel-air ratio of the fuel-air mixture varies only slightly and hence, the normal operation of the engine can be ensured.

The construction for finely dividing the fuel vapor at the location short of the inlet bore 36 in the valve seat member 37 is a simple construction wherein the porous element 52 is placed in the fuel vapor treating chamber 51, leading to a very small increase in cost.

Although the embodiment of the present invention has been described in detail, it will be understood that the present invention is not limited to the above-described embodiment, and various modifications in design may be made without departing from the spirit and scope of the invention defined in claims. For example, the throttle valve 4 may be constructed into a butterfly type.

What is claimed is:

1. A diaphragm carburetor comprising a constant-pressure fuel chamber having an outlet bore and an inlet bore, a fuel nozzle, a fuel jet and a check valve, said fuel chamber communicating at said outlet bore with a lower end of said fuel nozzle through said fuel jet and check valve, a fuel passage communicating between said inlet bore in said constant-pressure fuel chamber and a fuel tank, a fuel pump communicating with said fuel passage for pumping fuel into said constant-pressure fuel chamber in response to a pulsation pressure from a pulsation pressure generating source, and a fuel introduction control valve for controlling the introduction of the fuel into said constant-pressure fuel chamber by opening and closing said inlet bore of said constant-pressure fuel chamber, said fuel introduction control valve having a cylindrical valve seat member mounted on an upper wall of said constant-pressure fuel chamber and having said inlet bore at an upper end thereof, and a valve member raised and lowered within said valve seat member to open and close said inlet bore, wherein a fuel vapor treating chamber is provided in said fuel passage for finely dividing fuel vapor at a location before said inlet bore.

2. A diaphragm carburetor according to claim 1, wherein a porous element having a large number of pores is placed in said fuel vapor treating chamber.

* * * * *